US008922324B2

(12) United States Patent
Idogawa et al.

(10) Patent No.: US 8,922,324 B2
(45) Date of Patent: Dec. 30, 2014

(54) IGNITION COIL FOR INTERNAL COMBUSTION ENGINE

(75) Inventors: Takashi Idogawa, Chiyoda-ku (JP); Takeshi Shimizu, Chiyoda-ku (JP); Shuichi Tamura, Chiyoda-ku (JP); Koji Takaba, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 513 days.

(21) Appl. No.: 13/030,402

(22) Filed: Feb. 18, 2011

(65) Prior Publication Data

US 2012/0103313 A1 May 3, 2012

(30) Foreign Application Priority Data

Oct. 29, 2010 (JP) ..... 2010-243634

(51) Int. Cl.
*H01F 27/24* (2006.01)
*H01F 21/00* (2006.01)
*H01F 38/12* (2006.01)

(52) U.S. Cl.
CPC ..... *H01F 38/12* (2013.01)
USPC ..... 336/216; 336/212; 336/110; 123/634

(58) Field of Classification Search
USPC ..... 336/90, 212, 110, 216, 217, 219; 123/634
See application file for complete search history.

(56) References Cited

U.S. PATENT DOCUMENTS 2,248,070 A * 7/1941 Fanger ..... 336/133
4,546,753 A * 10/1985 Pierret ..... 123/634
4,990,881 A * 2/1991 Ooyabu ..... 336/110
5,685,065 A * 11/1997 Suzuki et al. ..... 29/606
5,692,483 A * 12/1997 Wada et al. ..... 123/634
6,369,687 B1 4/2002 Akita et al.

(Continued)

FOREIGN PATENT DOCUMENTS

JP 1993029113 U 4/1993
JP 06-036950 A 2/1994

(Continued)

OTHER PUBLICATIONS

Japanese Office Action, Patent Application No. 2010-243634, Nov. 6, 2012.

*Primary Examiner* — Mangtin Lian
(74) *Attorney, Agent, or Firm* — Sughrue Mion, PLLC

(57) ABSTRACT

An ignition coil for internal combustion engine includes: a center core disposed on an inner side of a primary coil and a secondary coil and a side core disposed on an outer side of the primary and secondary coils whose one end face abuts on one end face of the center core and the other end face abuts on the other end face of the center core via a magnet. The side core is formed of a plurality of side core portions obtained by dividing laminated magnetic steel plates at different positions in a longitudinal direction thereof and has a superimposed portion in which the magnetic steel plates of the adjacent side core portions mutually superimpose between the different positions in the longitudinal direction. It thus becomes possible to provide an ignition coil for internal combustion engine capable of suppressing an increase of magnetic circuit resistance markedly without deteriorating assembly workability.

5 Claims, 5 Drawing Sheets

(56) References Cited

U.S. PATENT DOCUMENTS

| | | | | |
|---|---|---|---|---|
| 6,538,548 | B2 | 3/2003 | Akita et al. | |
| 6,646,535 | B2 * | 11/2003 | Miyake et al. | 336/212 |
| 7,202,767 | B2 | 4/2007 | Maekawa et al. | |
| 7,843,306 | B2 * | 11/2010 | Mehendale et al. | 336/216 |
| 2002/0075121 | A1 | 6/2002 | Akita et al. | |
| 2005/0212636 | A1 * | 9/2005 | Kawai et al. | 336/90 |
| 2006/0226945 | A1 * | 10/2006 | Maekawa et al. | 336/90 |

FOREIGN PATENT DOCUMENTS

| | | | |
|---|---|---|---|
| JP | 2000-201458 | A | 7/2000 |
| JP | 2003-134701 | A | 5/2003 |
| JP | 2003217939 | A | 7/2003 |
| JP | 2006-294914 | A | 10/2006 |
| JP | 2006294914 | A | 10/2006 |
| JP | 2009054927 | A | 3/2009 |

* cited by examiner

IGNITION COIL FOR INTERNAL COMBUSTION ENGINE

BACKGROUND OF THE INVENTION

1. Field of the Invention

The present invention relates to an ignition coil for internal combustion engine that supplies a high voltage to a spark plug of an internal combustion engine.

2. Background Art

A core of a closed magnetic circuit configuration used in an ignition coil for internal combustion engine in the related art is formed of a center core disposed on an inner side of a primary coil and a secondary coil and a side core whose one end face abuts on one end face of the center core and the other end face abuts on the other end face of the center core via a magnet. Even when dimensions of the center core, the magnet, and the side core vary to some extent, deterioration in workability when assembling respective components is prevented by dividing the side core into two parts (see, for example, Patent Document 1).

Patent Document 1: JP-A-2006-294914

According to the ignition coil for internal combustion engine in the related art, because the side core is divided into two parts as described above, displacement at divided surfaces gives rise to magnetic circuit resistance, which deteriorates performance of the ignition coil. In order to lessen the displacement at the divided surfaces, the divided surfaces are formed diagonally. When viewed microscopically, however, it has been impossible to avoid a generating factor of the magnetic circuit resistance due to production tolerance, such as sagging occurring when the core is punched out with a mold. In order to reduce the magnetic circuit resistance, it is necessary to laminate a large number of magnetic steel sheets by adopting the thinnest plate possible as a core material, and further to perform processing, such as edge working on a punched sagging surface in a downstream process.

SUMMARY OF THE INVENTION

In view of the foregoing problems, the invention has an object to provide an ignition coil for internal combustion engine capable of suppressing an increase of magnetic circuit resistance markedly without deteriorating assembly workability.

An ignition coil for internal combustion engine according to one aspect of the invention includes a center core disposed on an inner side of a primary coil and a secondary coil and a side core disposed on an outer side of the primary coil and the secondary coil whose one end face abuts on one end face of the center core and the other end face abuts on the other end face of the center core via a magnet. The side core is formed of a plurality of side core portions obtained by dividing laminated magnetic steel plates at different positions in a longitudinal direction thereof and has a superimposed portion in which the magnetic steel plates of the adjacent side core portions mutually superimpose between the different positions in the longitudinal direction.

According to the configuration described above, it becomes possible to obtain an ignition coil for internal combustion engine capable of suppressing an increase of magnetic circuit resistance markedly without deteriorating assembly workability.

The foregoing and other object, features, aspects, and advantages of the present invention will become more apparent from the following detailed description of the present invention when taken conjunction with the accompanying drawings.

DESCRIPTION OF THE PREFERRED EMBODIMENTS

First Embodiment

Figure 1:
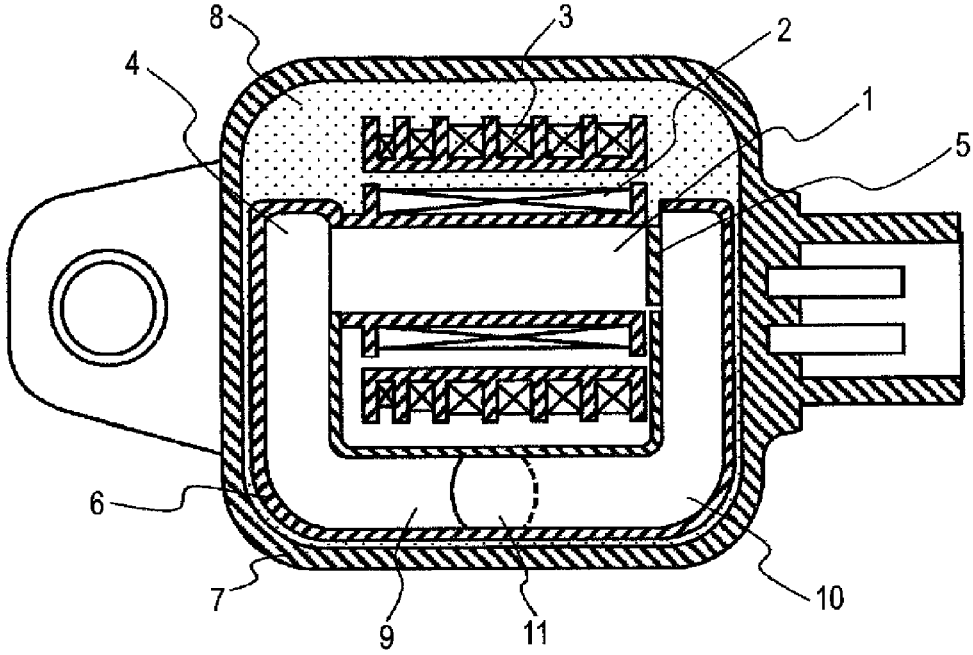
FIG. 1 shows a cross section of an ignition coil for internal combustion engine according to a first embodiment of the invention.
Figure 2:
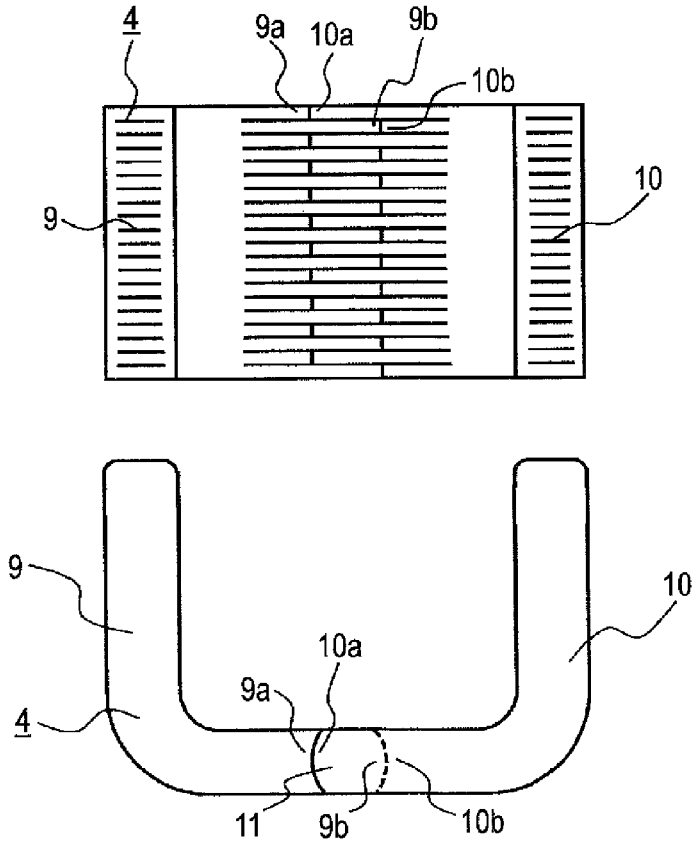
FIG. 2 shows a top view and a front view of a side core of FIG. 1.

FIG. 1 shows a cross section of an ignition coil for internal combustion engine according to a first embodiment of the invention. FIG. 2 shows a top view and a front view of a side core 4 of FIG. 1.

The ignition coil for internal combustion engine includes a primary coil 2 on an outer side of a substantially I-shaped center core 1 formed by laminating magnetic steel plates. A secondary coil 3 is disposed on an outer side of the primary coil 2.

A magnet 5 magnetized in an opposite direction to a direction of a magnetic flux induced by energization of the primary coil 2 abuts on one end face of the center core 1. The substantially U-shaped side core 4 that forms a closed magnetic circuit together with the center core 1 and the magnet 5 is disposed on an outer side of the secondary coil 3. The side core 4 is covered with an elastic core cover 6 made of thermoplastic elastomer, which is elastic resin, except for an inner side at both ends.

The center core 1, the primary coil 2, the secondary coil 3, the side core 4, the magnet 5, and the core cover 6 are accommodated in a case 7 and fixed therein with an insulating resin 8, which is thermo-setting epoxy resin.

The side core 4 is formed of two substantially L-shaped side core portions 9 and 10 formed by laminating magnetic steel plates. The side core portions 9 and 10 are cut by shifting the laminated magnetic steel plates one by one so that the magnetic steel plates are divided at different positions in the longitudinal direction thereof.

One end 9*a* of the first side core portion 9 and one end 10*a* of the second side core portion 10 abut on each other and the other end 9*b* of the first side core portion 9 and the other end 10*b* of the second side core portion 10 abut on each other. Owing to this configuration, a superimposed portion 11 is formed, in which the magnetic steel plates of the both side core portions 9 and 10 superimpose mutually at different dividing positions in the longitudinal direction thereof.

As has been described, the ignition coil for internal combustion engine of the first embodiment includes the center core 1 disposed on an inner side of the primary coil 2 and the secondary coil 3 and the side core 4 disposed on the outer side of the primary coil 2 and the secondary coil 3 whose one end face abuts on one end face of the center core 1 and the other end face abuts on the other end face of the center core 1 via the magnet 5. The side core 4 is formed of a plurality of the side core portions 9 and 10 in which the laminated magnetic steel plates are divided at different positions in the longitudinal direction thereof. The side core 4 has the superimposed portion 11 in which the magnetic steel plates of the adjacent side core portions 9 and 10 superimpose mutually between the different positions in the longitudinal direction thereof. Owing to this configuration, laminated surfaces of the side core portions 9 and 10 abut on each other, which makes it possible to ensure a markedly large contact surface in comparison with a case where the side core portions abut on each other merely on divided surfaces alone. It thus becomes possible to markedly suppress an increase of magnetic circuit resistance.

Further, because the two side core portions 9 and 10 are held by each other on the laminated surfaces, they can be supplied to a molding die at one time for insert molding. The ignition coil for internal combustion engine can be thus manufactured at a low price.

The first embodiment above has described a case where a dividing position of the magnetic steel plates is shifted plate by plate. It is, however, also possible to shift the dividing position in every group of several magnetic steel plates depending on product required performance.

Also, the above has described a case where two side core portions are used and there is only one superimposed portion (wrap portion). It is, however, also possible to provide more than one superimposed portion by using two or more side core portions.

Further, the both side core portions are held by each other but movable with a slight force. Hence, by molding the both integrally from thermoplastic elastomer, it becomes possible to conduct a work by stretching out the side core when it is assembled with the center core and the magnet, thus workability is enhanced.

Furthermore, the molded thermoplastic elastomer functions as a buffer between the insulating resin, which is epoxy resin, and the respective cores. It thus becomes possible to prevent epoxy resin cracking caused by application of heat stress.

Second Embodiment

Figure 3:
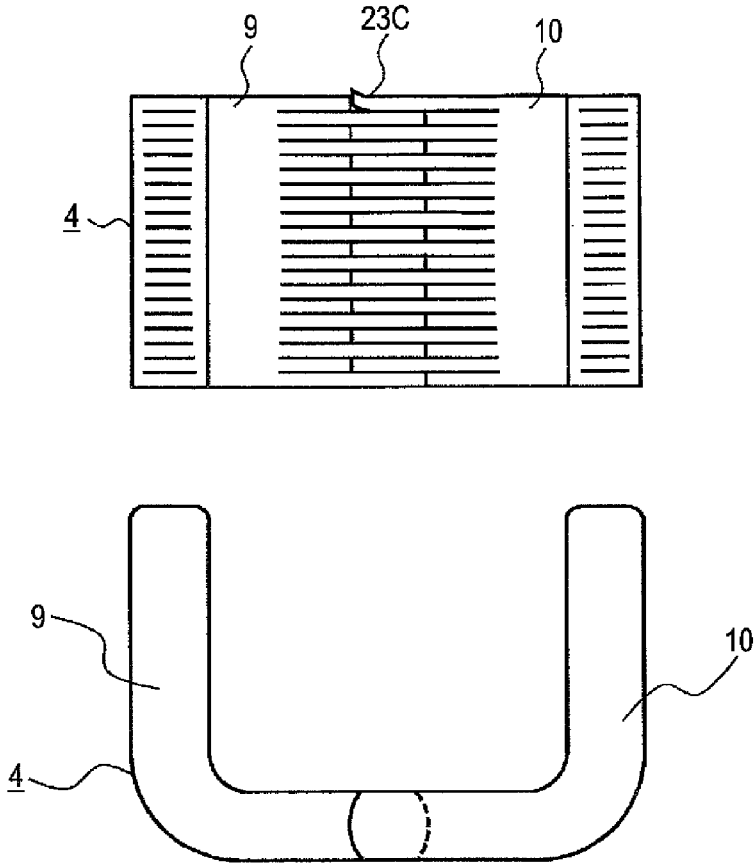
FIG. 3 shows a top view and a front view of a side core according to a second embodiment of the invention.
Figure 4:
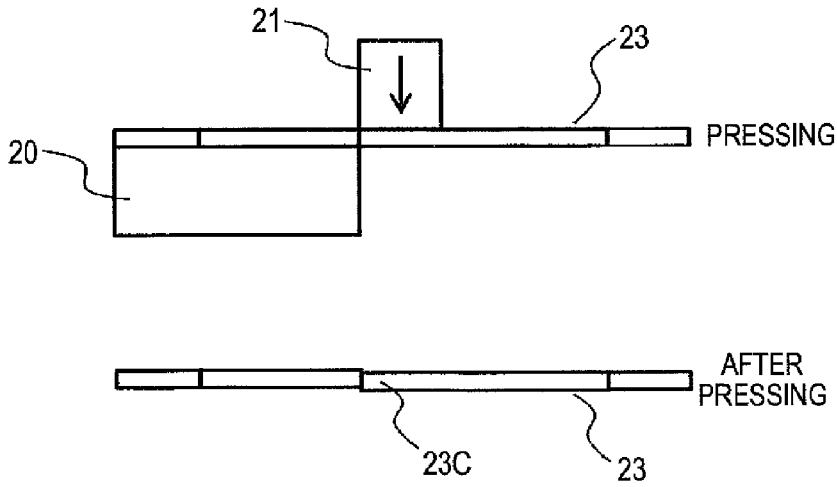
FIG. 4 shows a view used to describe an operation of a pressing die when lamination pressing is performed on the side core.
Figure 5:
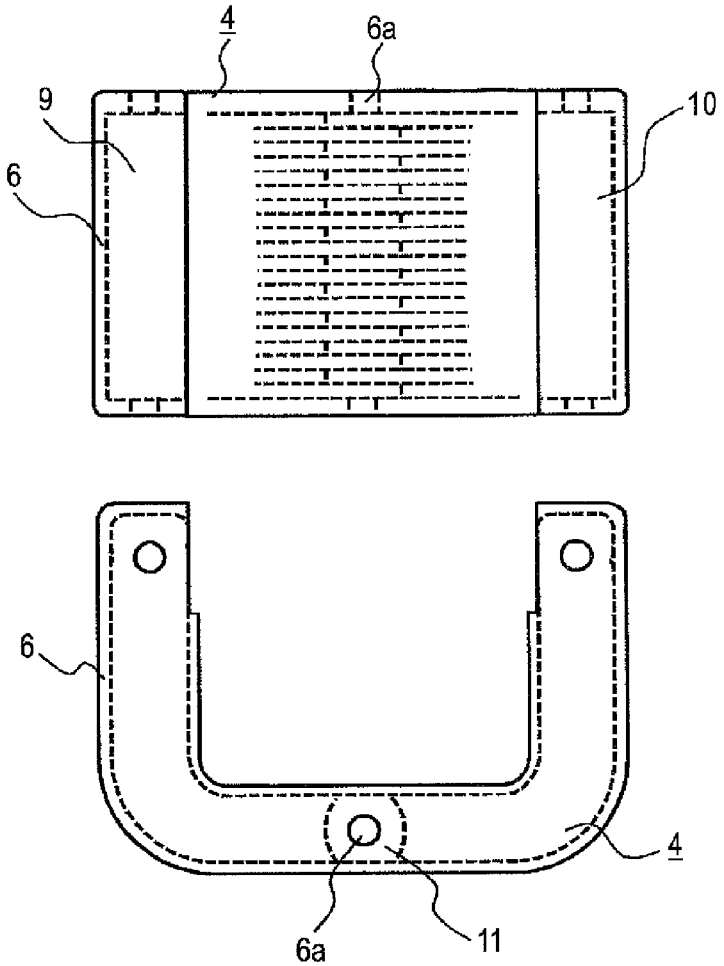
FIG. 5 shows a top view and a front view of the side core after it is insert molded from thermoplastic elastomer.

FIG. 3 shows a top view and a front view of a side core according to a second embodiment of the invention. FIG. 4 shows a view used to describe an operation of a pressing die when lamination pressing is performed on the side core. FIG. 5 shows a top view and a front view of the side core of FIG. 3 after it is insert molded from thermoplastic elastomer.

When the side core 4 is formed by laminating magnetic steel plates, the magnetic steel plates are laminated as a magnetic steel plate 23 is placed on a fix die 20 of a mold and cut by depressing a cutting blade 21. Accordingly, a deformed portion called a burr 23*c* is formed in every cutting operation. The burr 23*c* is leveled off when one magnetic steel plate and another magnetic steel plate to be laminated next are superimposed and a portion positioned at a lamination end face is leveled off by being pressed on by a pressing pin 6*a* used when the side core 4 is insert molded from thermoplastic elastomer so as to be covered with the core cover 6.

As has been described, the side core 4 of the second embodiment is configured in such a manner that the superimposed portion 11, in which the first side core portion 9 and the second side core portion 10 are superimposed mutually, is pressed on by the molding die used for insert molding, so that the deformation in the burr on the laminated end face is corrected and leveled off. Consequently, a gap between the laminated plates abutting on each other can be eliminated. It thus becomes possible to obtain a high-performance ignition coil that suppresses an increase of the magnetic resistance.

Third Embodiment

Figure 6:
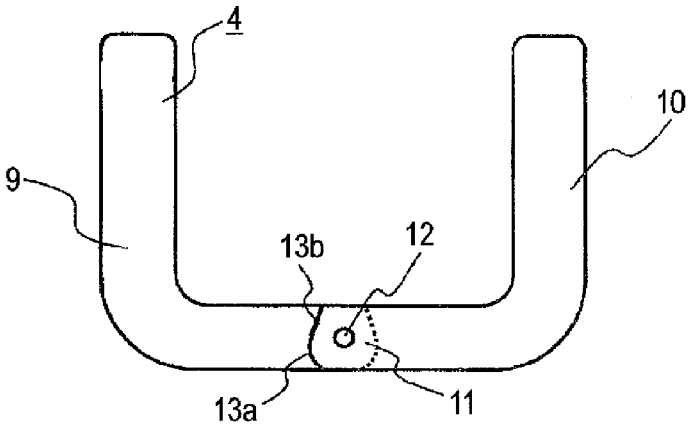
FIG. 6 shows a front view of a side core according to a third embodiment of the invention.
Figure 7:
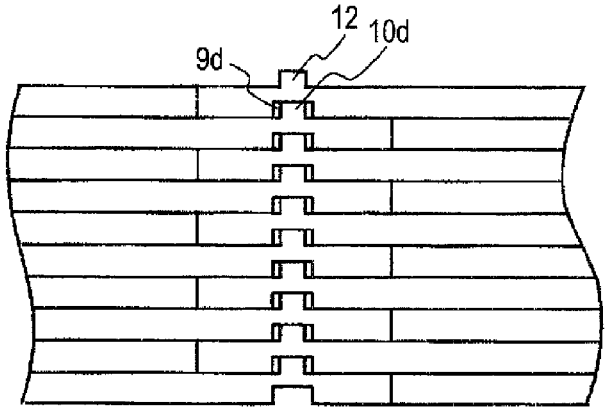
FIG. 7 shows a cross section of a major part representing a positioning portion of the side core.

FIG. 6 shows a front view of a side core according to a third embodiment of the invention. FIG. 7 shows a cross section of a major part representing a positioning portion of the side core.

The side core 4 of the third embodiment is divided to the first side core portion 9 and the second side core portion 10 and the dividing position is shifted plate by plate. A positioning portion 12 is provided to the superimposed portion 11 of the side core portions 9 and 10. The positioning portion 12 is formed by fitting a concave portion 9*d* of the first side core portion 9 and a convex portion 10*d* of the second side core portion 10. The side core 4 is allowed to rotate about the positioning portion 12 as an axis.

Further, a matching surface shape of the first side core portion 9 and the second side core portion 10 is formed in such a manner that a circular portion 13*a* about the positioning portion 12 is disposed on an outer side and a linear portion 13*b* in contact with the circular portion 13*a* is disposed on an inner side. The substantially U-shaped side core 4 is thus allowed to rotate outward but restricted not to rotate inward by the linear portion 13*b*.

As has been described, the side core 4 of the third embodiment includes the positioning portion 12 provided to the superimposed portion 11 of the side core portions 9 and 10. The side core 4 is therefore allowed to rotate about the positioning portion 12 as the axis. However, because the divided first side core 9 and second side core 10 do not separate from each other, the assembly performance with the center core 1 and the magnet 5 is further enhanced and an assembly work time can be shortened.

Further, because the matching surface shape of the first side core portion 9 and the second side core portion 10 is formed in such a manner that the circular portion 13*a* about the positioning portion 12 is disposed on the outer side of the substantially U-shaped core 4 and the linear portion 13*b* in contact with the circular portion 13*a* is disposed on the inner side, the rotation direction of the both side core portions 9 and 10 is limited to a direction in which the substantially U shape opens, that is, the side core 4 is restricted to be movable only in a direction in which it is easily installed to the center core 1 and the magnet 5. The installment performance is thus enhanced.

A restriction amount can be changed by changing a ratio of the circular portion 13*a* and the linear portion 13*b*. Hence, an adjustment is possible depending on a variance amount of the center core 1 and the magnet 5.

Fourth Embodiment

Figure 8:
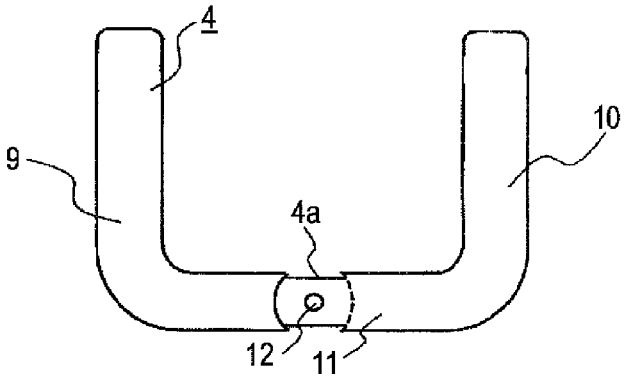
FIG. 8 shows a front view of a side core according to a fourth embodiment of the invention.

FIG. 8 shows a front view of a side core according to a fourth embodiment of the invention.

As with the counterpart of the third embodiment above, the side core 4 of the fourth embodiment includes the positioning portion 12 in the superimposed portion 11 of the both side core portions 9 and 10. However, a width of a side core 4*a* in the superimposed portion 11 of the both side core portions 9 and 10 is set smaller than that in the other portions.

As has been described, the side core 4 of the fourth embodiment is configured in such a manner that the width thereof in the superimposed portion 11 of the first side core portion 9 and the second core portion 10 is set smaller than that in the other portions. Accordingly, for example, even when the center core 1 and the magnet 5 to be assembled together are longer and installed to the substantially U-shaped side core 4 in an open state, the side core 4 at a ground potential does not approximate to the secondary coil 3, which is a high-voltage generation portion. An insulating distance can be therefore ensured. It thus becomes possible to provide a highly reliable product.

Fifth Embodiment

Figure 9:
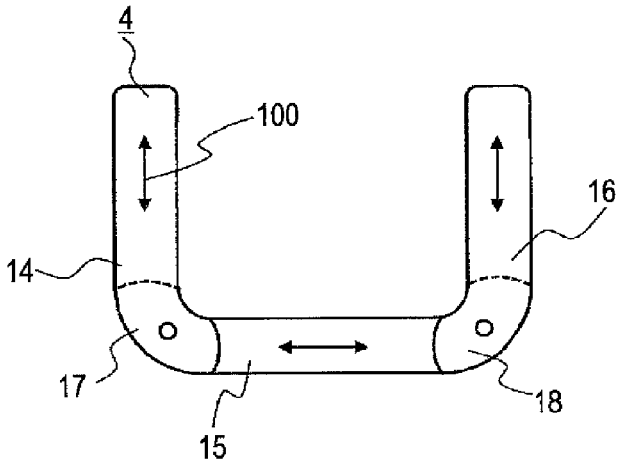
FIG. 9 shows a front view of a side core according to a fifth embodiment of the invention.
Figure 10:
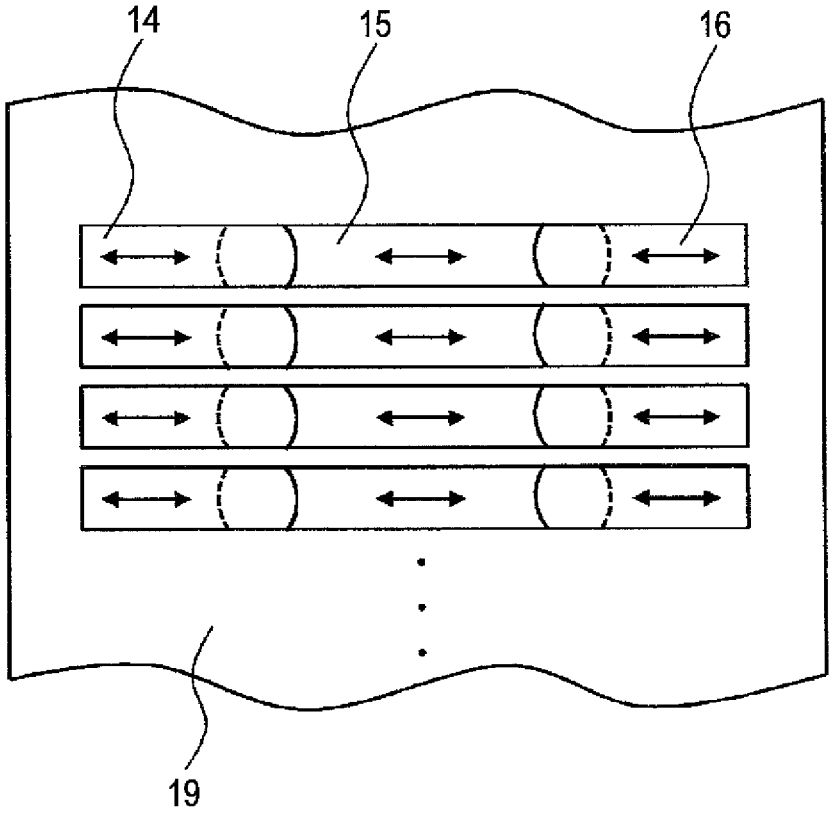
FIG. 10 shows a layout view during pressing of the side core.

FIG. 9 shows a front view of a side core according to a fifth embodiment of the invention. FIG. 10 shows a layout view during pressing of the side core.

The side core 4 of the fifth embodiment is formed substantially in the shape of a capital U using three I-shaped side core portions 14, 15, and 16. The side core portions 14, 15, and 16 are formed of grain-oriented magnetic steel plates. They are formed in such a manner that the longitudinal direction thereof is in a magnetization easy direction 100 and that corners 17 and 18 are the superimposed portions 11 in which the dividing position of the grain-oriented magnetic steel plates is shifted plate by plate (the manner of which is not shown).

As has been described, the side core 4 of the fifth embodiment is formed of three I-shaped side core portions 14, 15, and 16. Hence, as is shown in FIG. 10, not only can the three side core portions 14, 15, and 16 be pressed linearly at the same time using a grain-oriented magnetic steel plate 19 but they can also be disposed in mutually close proximity. Hence, a yield at the time of pressing becomes extremely satisfactory.

All of the three portions forming substantially the U shape are formed in the magnetization easy direction of the grain-oriented magnetic steel plate 19. It thus becomes possible to obtain a high-performance ignition coil through which a magnetic flux readily passes.

Various modifications and alterations of this invention will be apparent to those skilled in the art without departing from the scope and spirit of this invention, and it should be understood that this is not limited to the illustrative embodiments set forth herein.

What is claimed is:

1. An ignition coil for internal combustion engine, comprising:

a center core disposed on an inner side of a primary coil and a secondary coil; and a side core disposed on an outer side of the primary coil and the secondary coil whose one end face abuts on one end face of the center core and the other end face abuts on the other end face of the center core via a magnet, wherein the side core is formed of a plurality of side core portions obtained by dividing laminated magnetic steel plates at different positions in a longitudinal direction thereof and has a superimposed portion in which the magnetic steel plates of the adjacent side core portions are mutually superimposed, but movable, between the different positions in the longitudinal direction, wherein the magnetic steel plates in the superimposed portion have an upper side and a lower side when viewed from a front view of the side core, the lower side being opposite the upper side, and wherein a width of the magnetic steel plates between the upper side and the lower side is smaller in superimposed portion than a width of the magnetic steel plate in other portions, such that the upper side and the lower side of the superimposed portion are inside the width magnetic steel plates in the other portions.

2. The ignition coil for internal combustion engine according to claim 1, wherein:

the side core is formed substantially in a shape of a capital U using two substantially L-shaped side core portions in which a dividing position of the magnetic steel plates is shifted plate by plate.

3. The ignition coil for internal combustion engine according to claim 2, wherein:

a periphery of the side core is covered with an elastic resin material.

4. The ignition coil for internal combustion engine according to claim 1, wherein:

said plurality of side core portions are held by each other but movable with a slight force.

5. An ignition coil for internal combustion engine, comprising:

a center core disposed on an inner side of a primary coil and a secondary coil; and a side core disposed on an outer side of the primary coil and the secondary coil whose one end face abuts on one end face of the center core and the other end face abuts on the other end face of the center core via a magnet, wherein the side core is formed of a plurality of side core portions obtained by dividing laminated magnetic steel plates at different positions in a longitudinal direction thereof and has a superimposed portion in which the magnetic steel plates of the adjacent side core portions are mutually superimposed, but movable, between the different positions in the longitudinal direction, a width of the magnetic steel plates is smaller in the superimposed portion than a width of the magnetic steel plates in other portions to ensure an insulating distance such that the side core at a ground potential does not approximate to the secondary coil, which is a high-voltage generation portion.

* * * * *